US008899870B1

(12) United States Patent
Hall

(10) Patent No.: US 8,899,870 B1
(45) Date of Patent: Dec. 2, 2014

(54) SURFACE PREPARATION SYSTEM

(71) Applicant: David R. Hall, Provo, UT (US)

(72) Inventor: David R. Hall, Provo, UT (US)

( * ) Notice: Subject to any disclaimer, the term of this patent is extended or adjusted under 35 U.S.C. 154(b) by 0 days.

(21) Appl. No.: 13/940,771

(22) Filed: Jul. 12, 2013

(51) Int. Cl.
*E01F 9/00* (2006.01)
*E01C 19/00* (2006.01)

(52) U.S. Cl.
CPC ..... *E01C 19/00* (2013.01)
USPC ..... 404/75; 404/92; 404/96

(58) Field of Classification Search
CPC ..... E01C 19/00
USPC ..... 404/89, 92, 96; 15/1
See application file for complete search history.

(56) References Cited

U.S. PATENT DOCUMENTS 2,830,511 A * 4/1958 Wills Marion C et al. ..... 404/86
3,071,051 A * 1/1963 Martin William E ..... 404/128
3,986,782 A * 10/1976 Durham ..... 404/85
4,001,902 A * 1/1977 Hall et al. ..... 5/121
4,040,762 A * 8/1977 Nilsson ..... 404/129
4,378,052 A * 3/1983 Anderson ..... 172/449
4,786,111 A 11/1988 Yargici
5,104,594 A 4/1992 Hillemeier et al.
5,561,921 A * 10/1996 Vanderlinden ..... 37/227
5,752,782 A * 5/1998 Hulicsko ..... 404/103
7,124,463 B2 * 10/2006 Mathews et al. ..... 15/84
7,281,296 B2 * 10/2007 Strauser ..... 15/348
7,458,645 B2 12/2008 Hall et al.
7,520,378 B2 * 4/2009 Hansen et al. ..... 198/807
7,607,860 B2 10/2009 Novak
7,837,751 B2 * 11/2010 Dunning et al. ..... 55/385.1
7,854,566 B2 12/2010 Hall et al.
8,079,777 B2 12/2011 Van Velsor
8,281,499 B2 10/2012 Friesen et al.
8,296,968 B2 10/2012 Hensley

* cited by examiner

*Primary Examiner* — Raymond W Addie
(74) *Attorney, Agent, or Firm* — Philip W. Townsend, III

(57) ABSTRACT

A surface preparation system, such as for surface milling, may comprise a degradation drum comprising a plurality of picks disposed on a vehicle to degrade a surface. A jet system may clean the surface with fluid after degradation. A roller comprising an absorbent material may then absorb fluid left on the surface.

20 Claims, 13 Drawing Sheets

SURFACE PREPARATION SYSTEM

CROSS-REFERENCE TO RELATED APPLICATIONS

This application claims priority to U.S. Provisional Pat. App. No. 61/678,362 filed on Aug. 1, 2012, which is incorporated herein by reference for all that it contains.

BACKGROUND OF THE INVENTION

The present invention relates generally to the field of surface milling and specifically to a system designed to remove excess liquid from a milled surface. Road surface milling machines commonly comprise a rotating drum with a plurality of picks disposed thereon that may engage and degrade a surface preparing the surface for adherence of a new layer. Fluid may be applied to the drum to cool the picks or jetted onto the milled surface to remove milled aggregate there from. For example, U.S. Pat. No. 7,458,645 to Hall et al., which is herein incorporated by reference for all that it contains, discloses a vehicle comprising a milling drum for removing a layer of a paved surface and a moldboard to push aggregate removed from the paved surface. A plurality of nozzles may be disposed on the moldboard which may provide fluid to push aggregate towards the milling drum while reducing the formation of dust particles.

Excess fluid, however, may run off the road and pollute the ground, hinder recycling efforts by soaking milled aggregate, and promote poor bonding between the milled surface and a new layer. U.S. Pat. No. 4,786,111 to Yargici, which is herein incorporated by reference for all that it contains, describes the difficulties resulting from excess fluid. To apply no more fluid than necessary, Yargici discloses a road milling machine including a hollow, cylindrically walled drum. Liquid coolant, such as water, is introduced into the drum. Coolant delivery openings are provided through the cylindrical drum wall in adjacent relation to each cutting tool and coolant flows out through these delivery openings when the drum is rotating.

U.S. Pat. No. 7,854,566 to Hall et al., which is herein incorporated by reference for all that it contains, discloses drying a milled surface with a gas, such as air, after water has been dispersed. In some embodiments, the air may be heated to help evaporate the moisture on the milled surface. In other embodiments, a suction device may be attached for removing moisture. In still other embodiments, a liquid absorbent may be deposited on the milled surface to absorb residual moisture left behind by the plurality of nozzles. In still further embodiments, a fan, heater or microwave element may be positioned to evaporate residual liquid from a milled surface.

Despite these advances, improved methods for removing excess fluid from a milled surface are still desirable.

BRIEF SUMMARY OF THE INVENTION

A surface preparation system, such as for road surface milling, may comprise a degradation drum comprising a plurality of picks disposed thereon to degrade a surface, a jet system to clean the surface with fluid after degradation, and a roller comprising an absorbent material to absorb the fluid from the surface. Such a surface may comprise known pavement materials such as concrete, cement, asphalt, macadam, tarmacadam or bitumen.

In various embodiments, the degradation drum and the roller may be disposed on the same vehicle or on separate vehicles. Where on separate vehicles, the roller vehicle may be self propelled or pulled behind the degradation drum vehicle.

The absorbent material may be disposed around an outer perimeter of the roller. The absorbent material may also be elastic such that it temporarily conforms to the surface.

The surface preparation system may also comprise a moisture extraction system to remove absorbed fluid from the roller. The moisture extraction system may comprise a wringer to remove fluid by compressing part of the absorbent material. The wringer may be shaped like a cylindrical rod that may rotate around an axis to ease abrasion between the wringer and the roller. In other embodiments, the wringer may be shaped like a channel to capture and channel fluid. The moisture extraction system may also comprise a vacuum and/or a heater to remove fluid from the roller.

The surface preparation system may further comprise a moisture collection system to gather the fluid removed from the roller. Various embodiments of the moisture collection system may comprise a pump to propel captured fluid to a fluid reservoir and a filter to remove impurities from the fluid so that it may be recycled to the jet system.

DETAILED DESCRIPTION OF THE INVENTION

Figure 1:
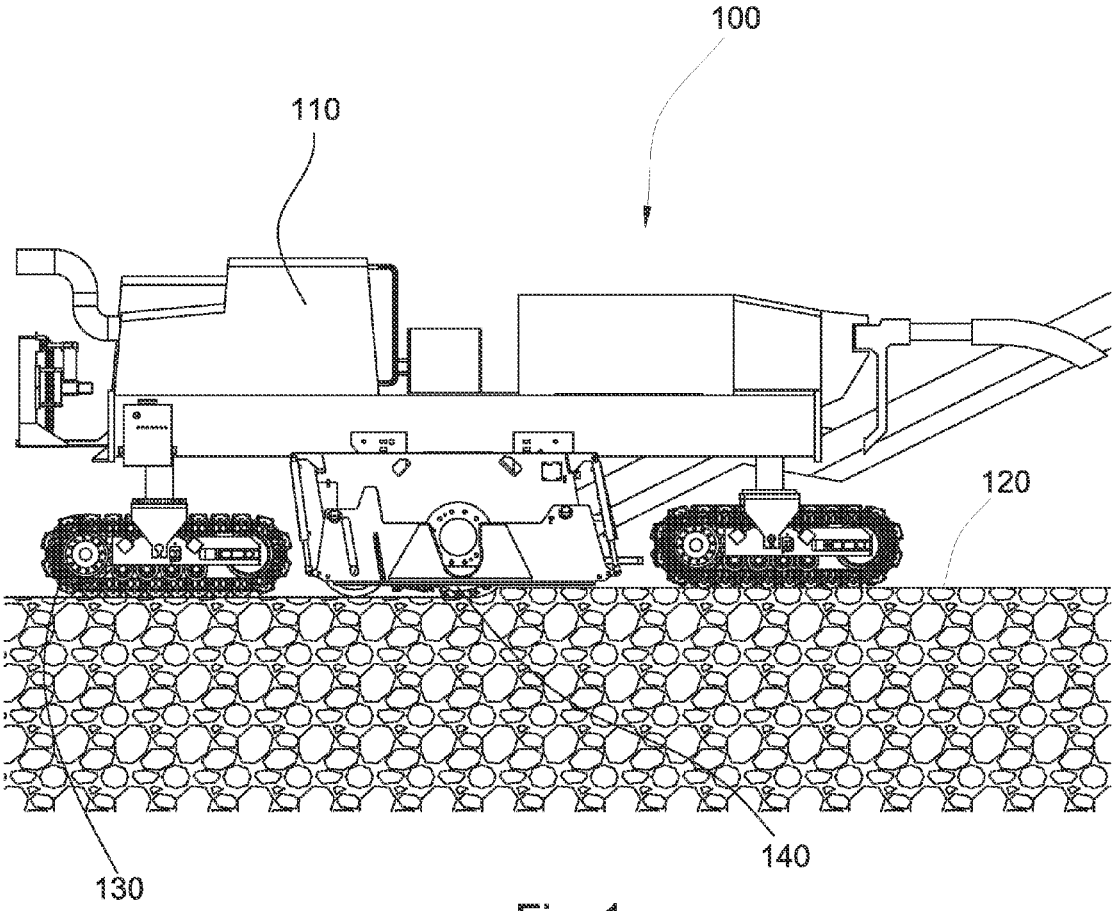
FIG. 1 shows a side view of an embodiment of a surface preparation system comprising a road milling machine with a degradation drum, a jet system, and a roller disposed thereon.

Referring now to the figures, FIG. 1 discloses an embodiment of a surface preparation system comprising a road milling machine 100. The road milling machine 100 may comprise a self-propelled vehicle 110 that may travel over a surface 120. In the embodiment shown the vehicle 110 is propelled by tracks 130, however, wheels or other means known in the art would also be suitable. A degradation drum 140 may be disposed on an underside of the vehicle 110 such that it may degrade the surface 120 as the vehicle 110 passes over.

Figure 2:
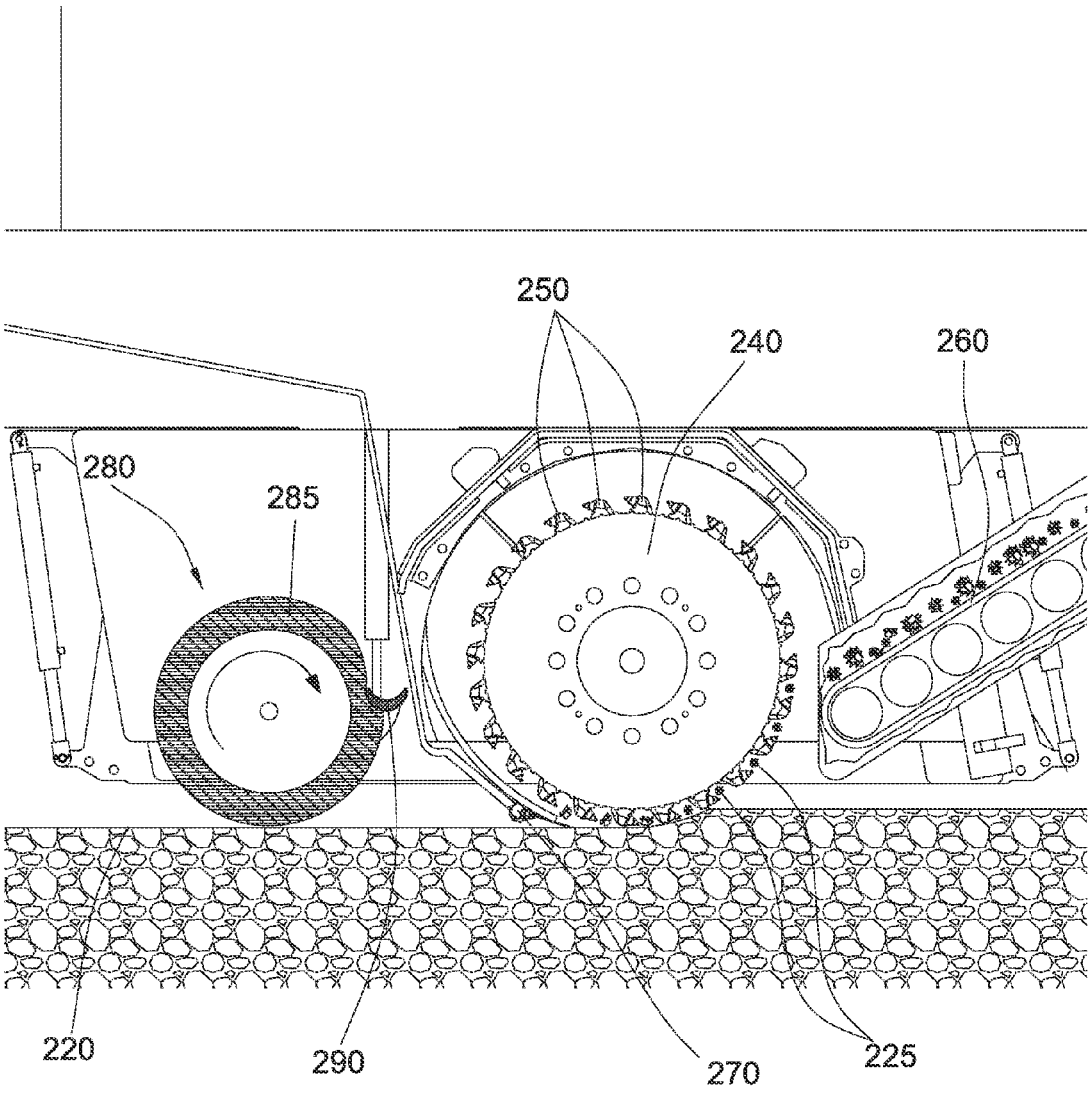
FIG. 2 shows a close-up view of an embodiment of a degradation drum, a jet system and a roller.

FIG. 2 discloses an embodiment of a degradation drum 240 similar to the one shown in FIG. 1. The degradation drum 240 may comprise a plurality of picks 250 disposed thereon. The degradation drum 240 may be rotated such that the plurality of picks 250 engage a surface 220 causing aggregate 225 to break away from the surface 220. In some embodiments, the aggregate 225 may be lifted by the degradation drum 240 onto a conveyor 260 for removal. A jet system 270 may be disposed such that it may jet fluid to clean the surface 220 of excess aggregate 225.

After cleaning the surface 220, excess fluid may run off the road thus polluting the surrounding area. Some excess fluid may attach to aggregate 225 removed by the conveyor 260 thus hindering aggregate recycling efforts. Excess fluid may also remain on the surface 220 thus promoting poor bonding between the degraded surface and a new layer. Due to the detrimental effects of excess fluid, it may be desirable to collect as much moisture as possible from the surface 220.

A roller 280 comprising an absorbent material 285 may be disposed such that it may soak up excess fluid from the surface 200. The absorbent material 285 may be positioned around an outer perimeter of the roller 280. The roller 280 may rotate as it travels along the surface 220 allowing fresh portions of the absorbent material 285 to engage the surface 220 and collect excess fluid. The excess fluid collected by the absorbent material 285 may then evaporate while rotating apart from the surface 220 or be wrung from the absorbent material 285 by a wringer 290.

Figure 3:
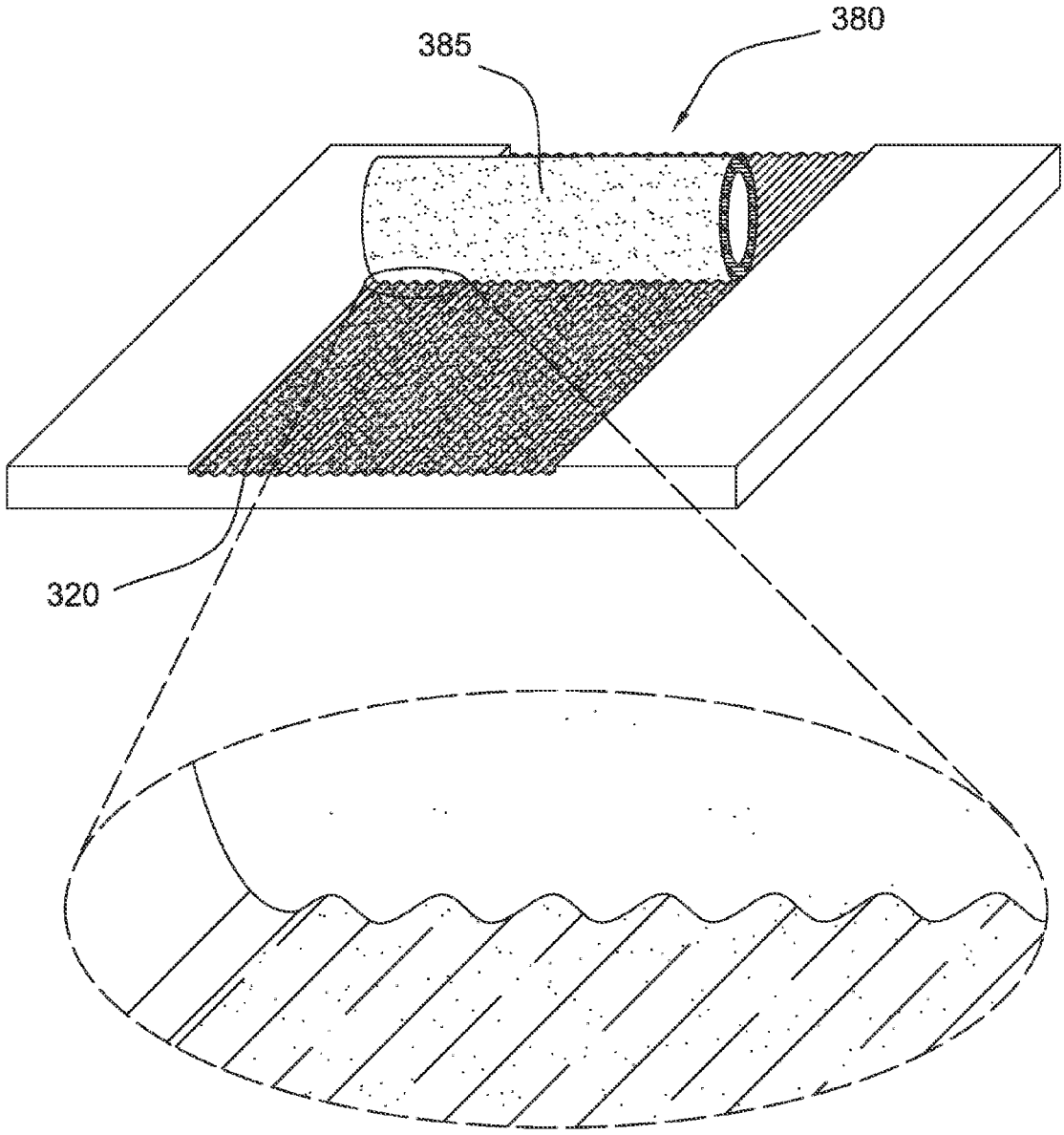
FIG. 3 shows a perspective view of an embodiment of an elastic roller conforming to a surface.

FIG. 3 discloses an embodiment of roller 380 traveling along a degraded surface 320. The remainder of the surface preparation system has been removed for clarity. In the embodiment shown, absorbent material 385, positioned around an outer perimeter of the roller 380, is elastic such that it conforms to irregularities in the degraded surface 320.

Figure 4:
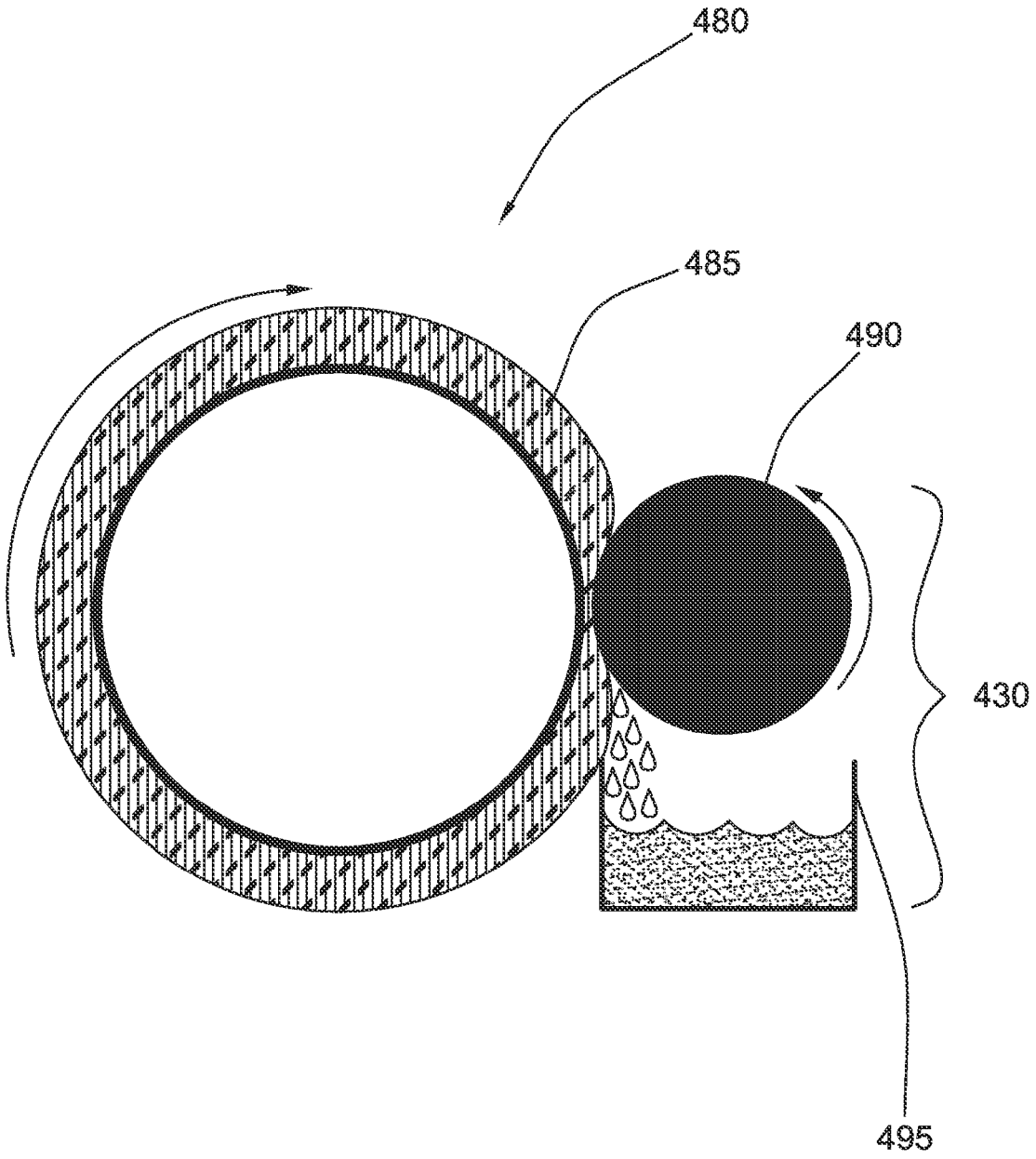
FIG. 4 shows a side view of an embodiment of a moisture extraction system comprising a cylindrical rod shaped wringer and a collector disposed outside a roller.

FIG. 4 discloses an embodiment of a roller 480 comprising an absorbent material 485 disposed thereon and a moisture extraction system 430 to remove absorbed fluid from the absorbent material 485. While natural evaporation may remove some absorbed fluid from the absorbent material 485 during rotation of the roller 480, it may be desirable to remove additional fluid by means of the moisture extraction system 430 to ensure a relatively dry surface for additional absorption upon complete rotation. In the embodiment shown, the moisture extraction system 430 comprises a cylindrical rod shaped wringer 490 that may compress a portion of the absorbent material 485 and squeeze fluid there from. The cylindrical rod shaped wringer 490 may rotate around an axis to ease the abrasion that may occur between the wringer 490 and the absorbent material 485 of the roller 480. A collector 495 may be disposed beneath the wringer 490 to catch fluid as it is wrung from the absorbent material 485. In the embodiment shown, the collector 495 is disposed outside of the roller 480. However, other positions for the collector 495 are anticipated.

Figure 5:
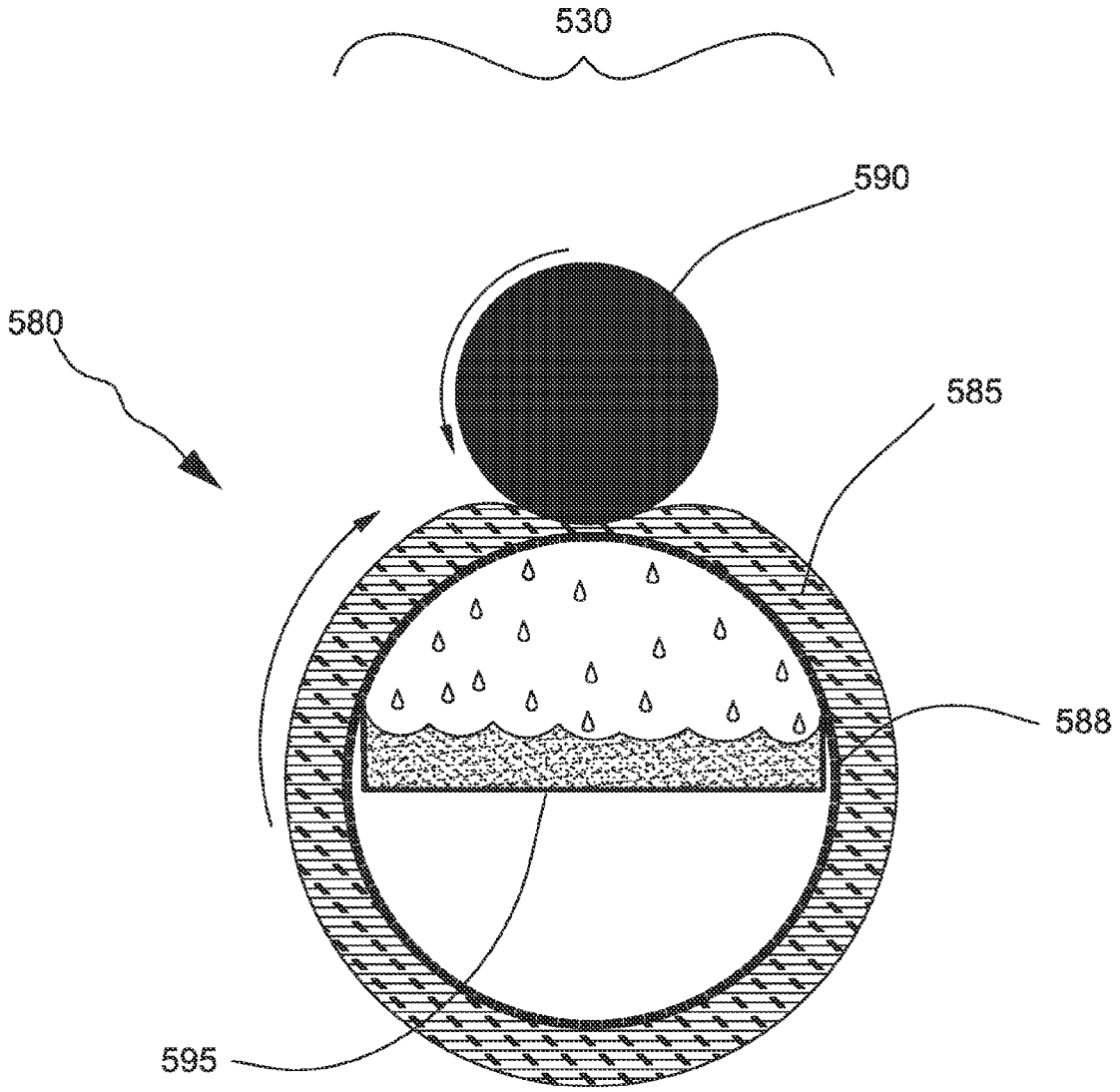
FIG. 5 shows a side view of an embodiment of a moisture extraction system comprising a cylindrical rod shaped wringer and a collector disposed within a roller.

FIG. 5 discloses another embodiment of a roller 580 comprising an absorbent material 585. In this embodiment, the absorbent material is disposed around a perforated cylinder 588. A moisture extraction system 530 may remove absorbed fluid from the absorbent material 585 by compressing a portion of the absorbent material 585 with a cylindrical rod shaped wringer 590 to squeeze fluid there from. A collector 595 may be disposed within the perforated cylinder 588 and catch fluid passing through the perforated cylinder 588 as it is wrung from the absorbent material 485.

Figure 6:
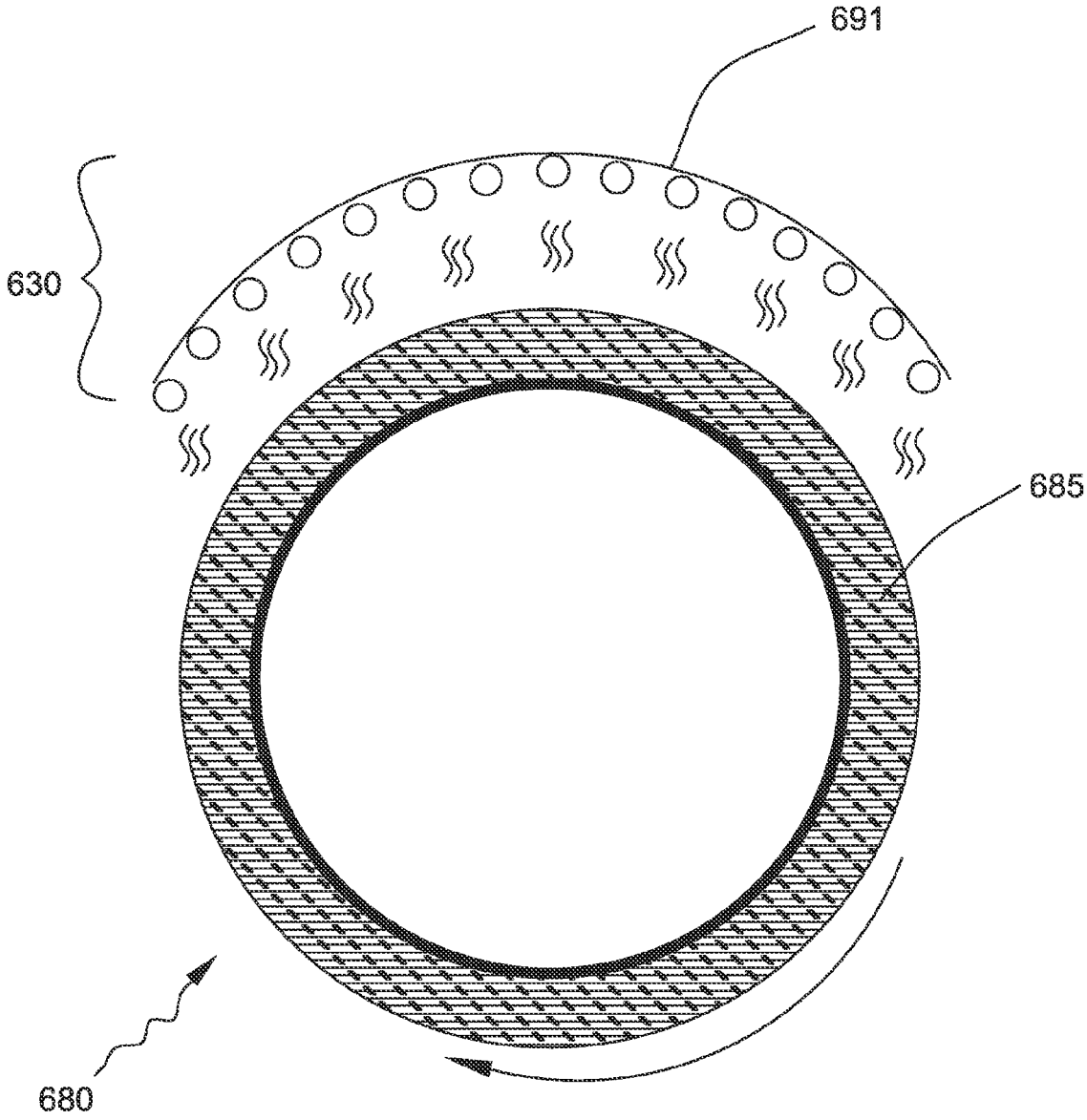
FIG. 6 shows a side view of an embodiment of a moisture extraction system comprising a heater disposed outside a roller.

FIG. 6 discloses another embodiment of a moisture extraction system 630 comprising a heater 691. The heater 691 may be disposed adjacent to an absorbent material 685 disposed on a roller 680 and may apply heat to aid in evaporating absorbed fluid.

Figure 7:
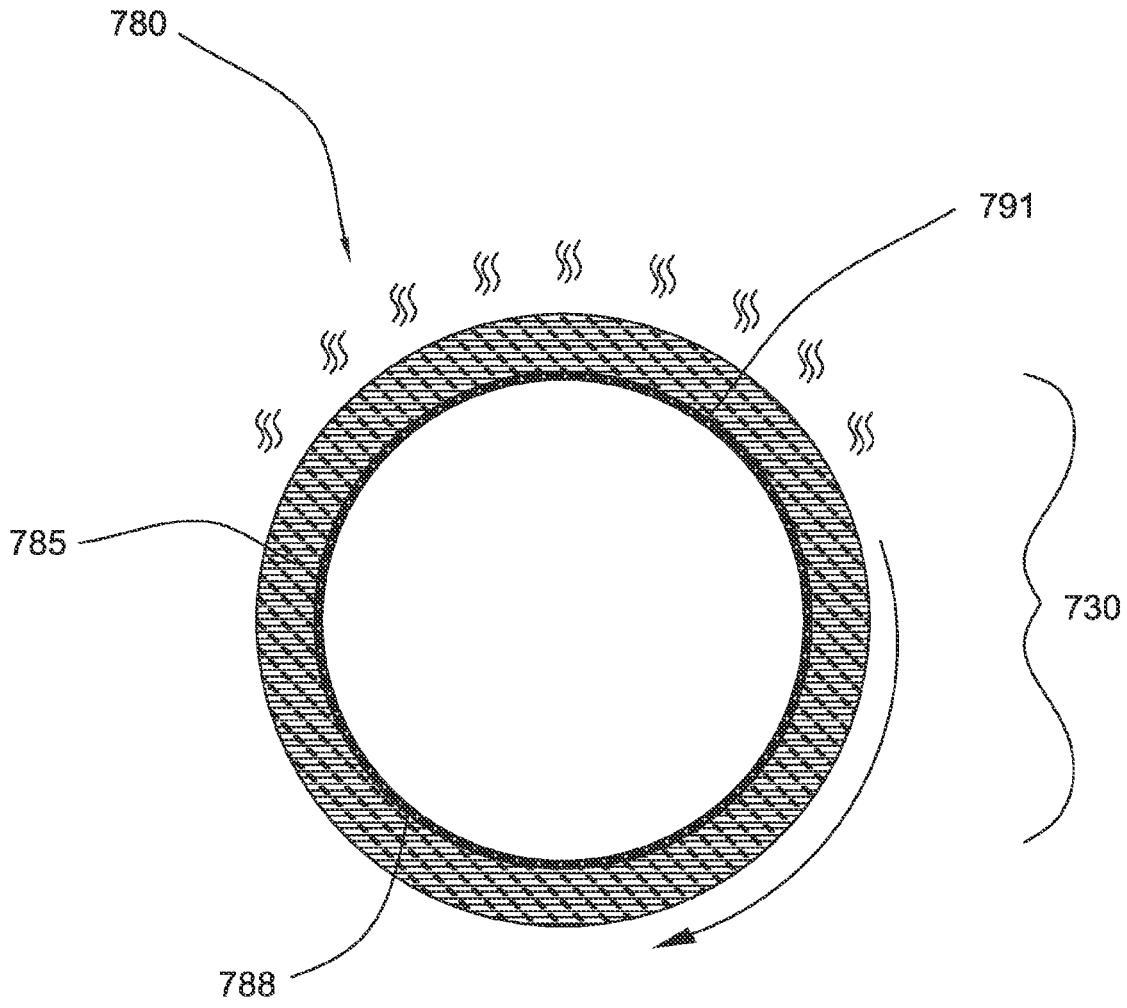
FIG. 7 shows a side view of an embodiment of a moisture extraction system comprising a heater disposed within a roller.

FIG. 7 discloses an embodiment of a moisture extraction system 730 similar to that disclosed in FIG. 6 in that it comprises a heater 791. However, in the present embodiment, the heater 791 is disposed within a cylinder 788 of a roller 780. Fluid may be removed from absorbent material 785 disposed around the cylinder 788 by evaporation aided by the heater 791.

Figure 8:
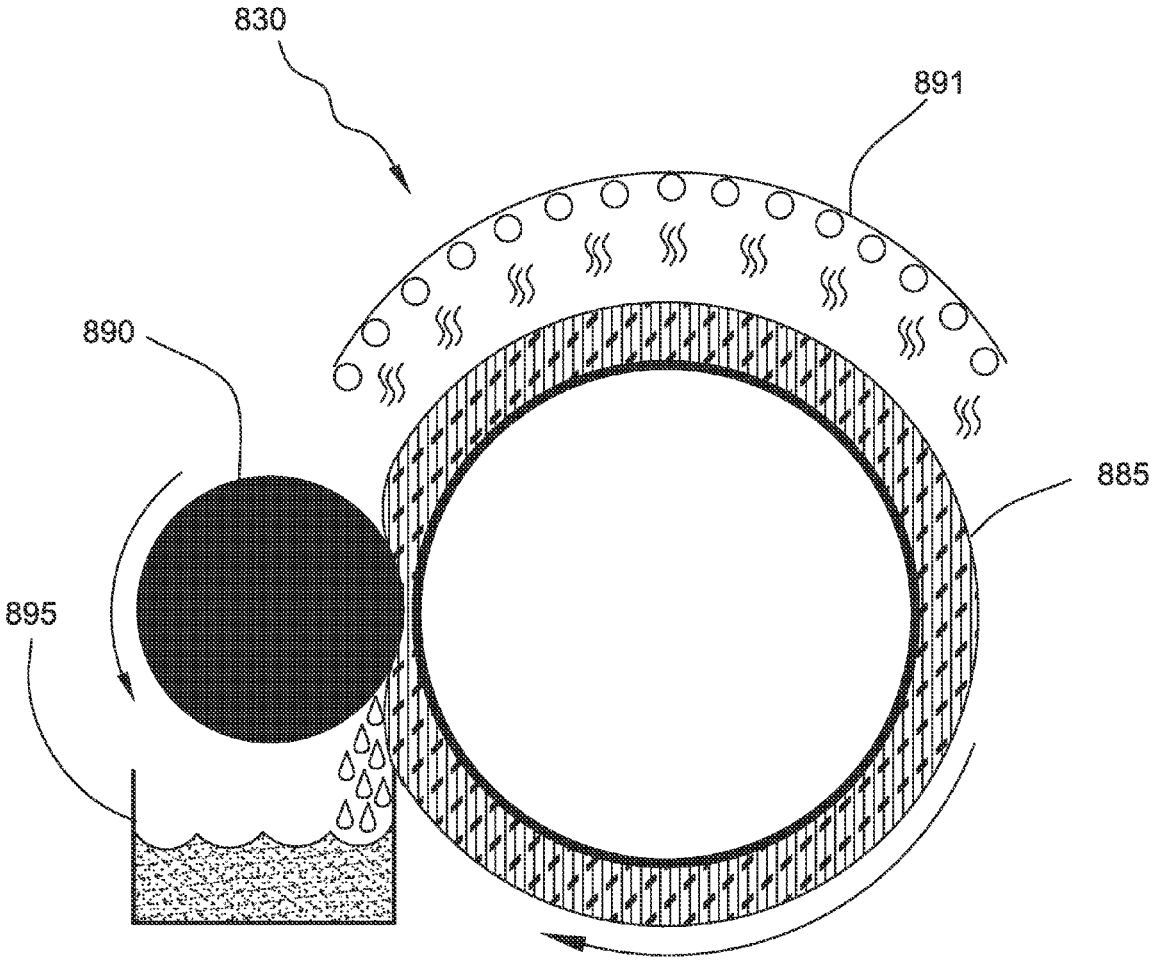
FIG. 8 shows a side view of an embodiment of a moisture extraction system comprising a cylindrical rod shaped wringer, a collector disposed outside a roller and a heater disposed outside the roller.
Figure 9:
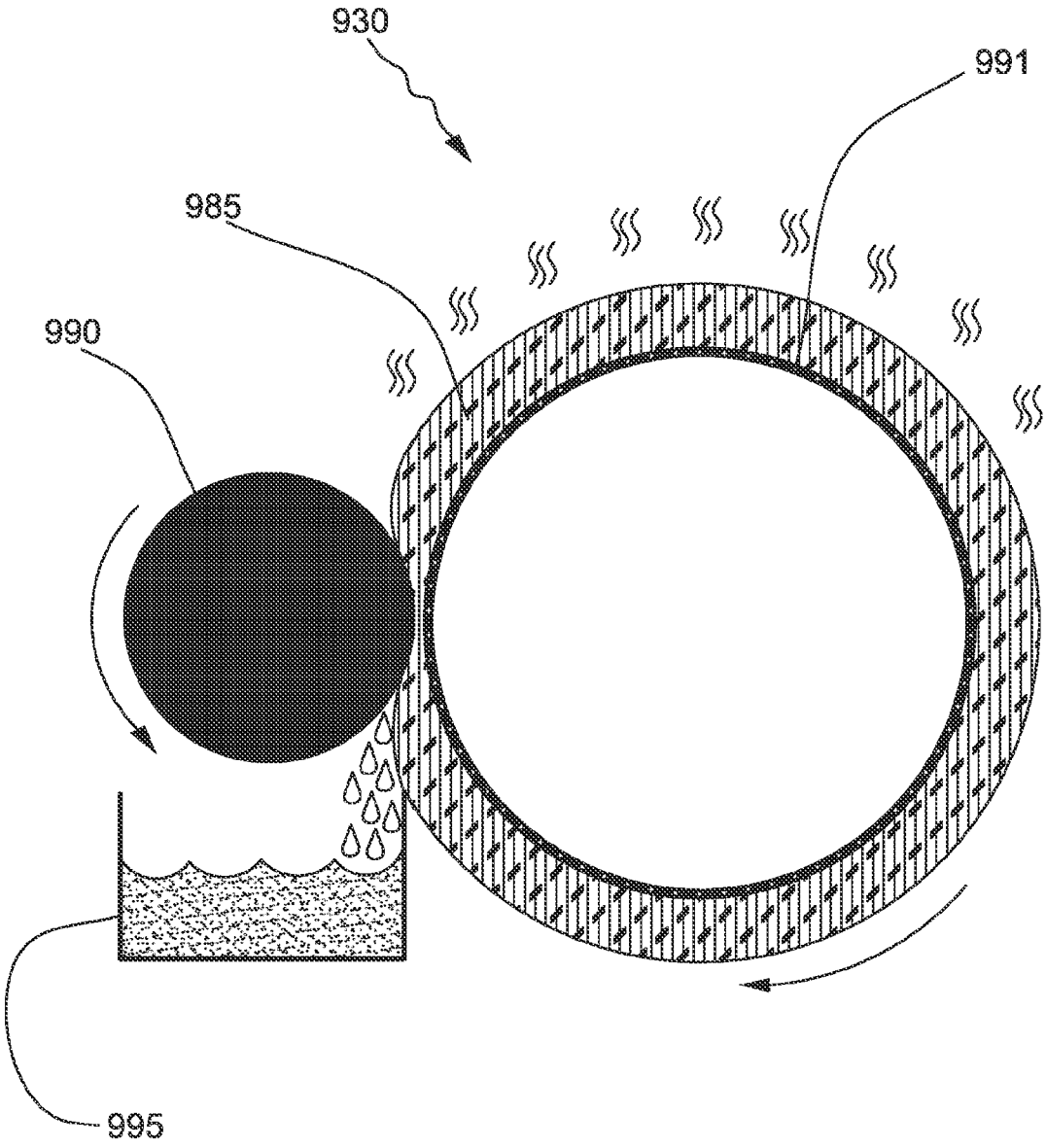
FIG. 9 shows a side view of an embodiment of a moisture extraction system comprising a cylindrical rod shaped wringer, a collector disposed outside a roller and an internal heater.

FIGS. 8 and 9 disclose embodiments of moisture extraction systems 830, 930 comprising both a cylindrical shaped wringer 890, 990 to squeeze fluid from an absorbent material 885, 985 into a collector 895, 995 and a heater 891, 991 to aid in evaporation of remaining fluid. FIGS. 8 and 9 differ in that the heater 891 in FIG. 8 is an adjacent heater while the heater 991 in FIG. 9 is an internal heater. These figures demonstrate that a variety of combinations of moisture extraction systems may be used together to enhance fluid removal.

Figure 10:
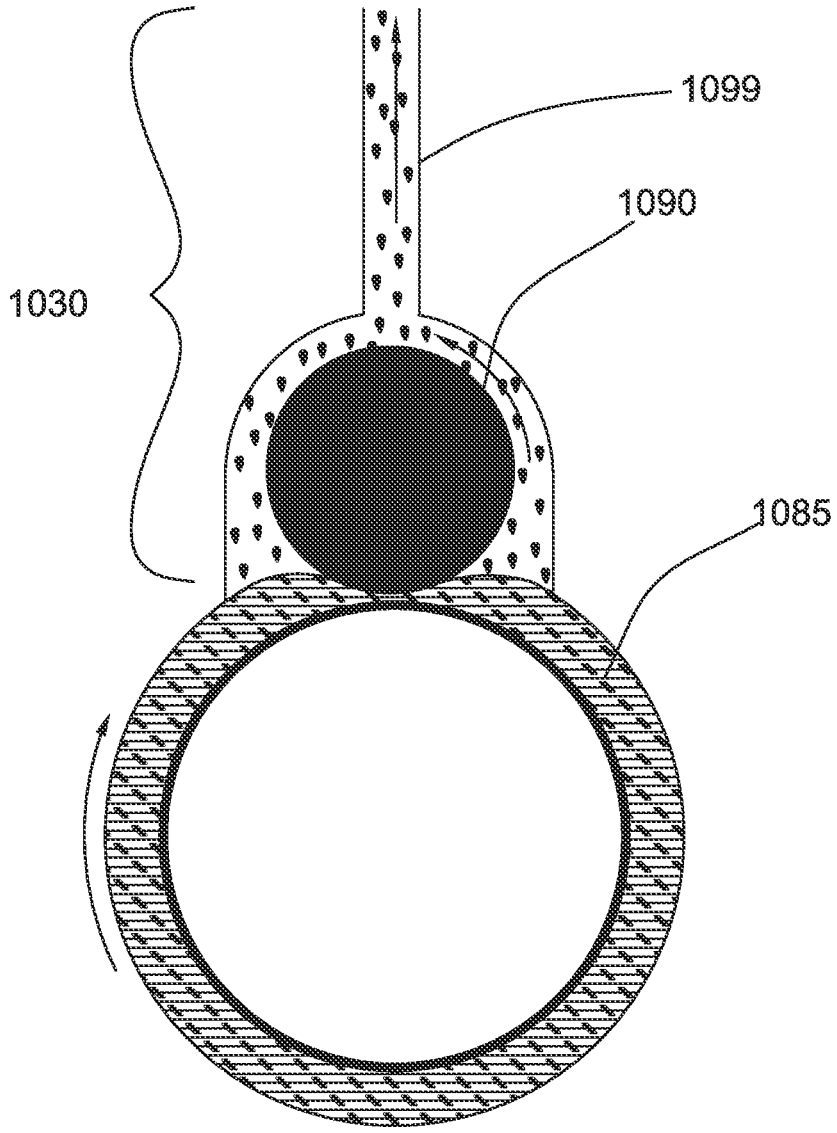
FIG. 10 shows a side view of an embodiment of a moisture extraction system comprising a cylindrical rod shaped wringer and a vacuum.

FIG. 10 discloses an embodiment of a moisture extraction system 1030 comprising a cylindrical rod shaped wringer 1090 and a vacuum 1099. As the wringer 1090 squeezes fluid from an absorbent material 1085, it may be suctioned away by the vacuum 1099.

Figure 11:
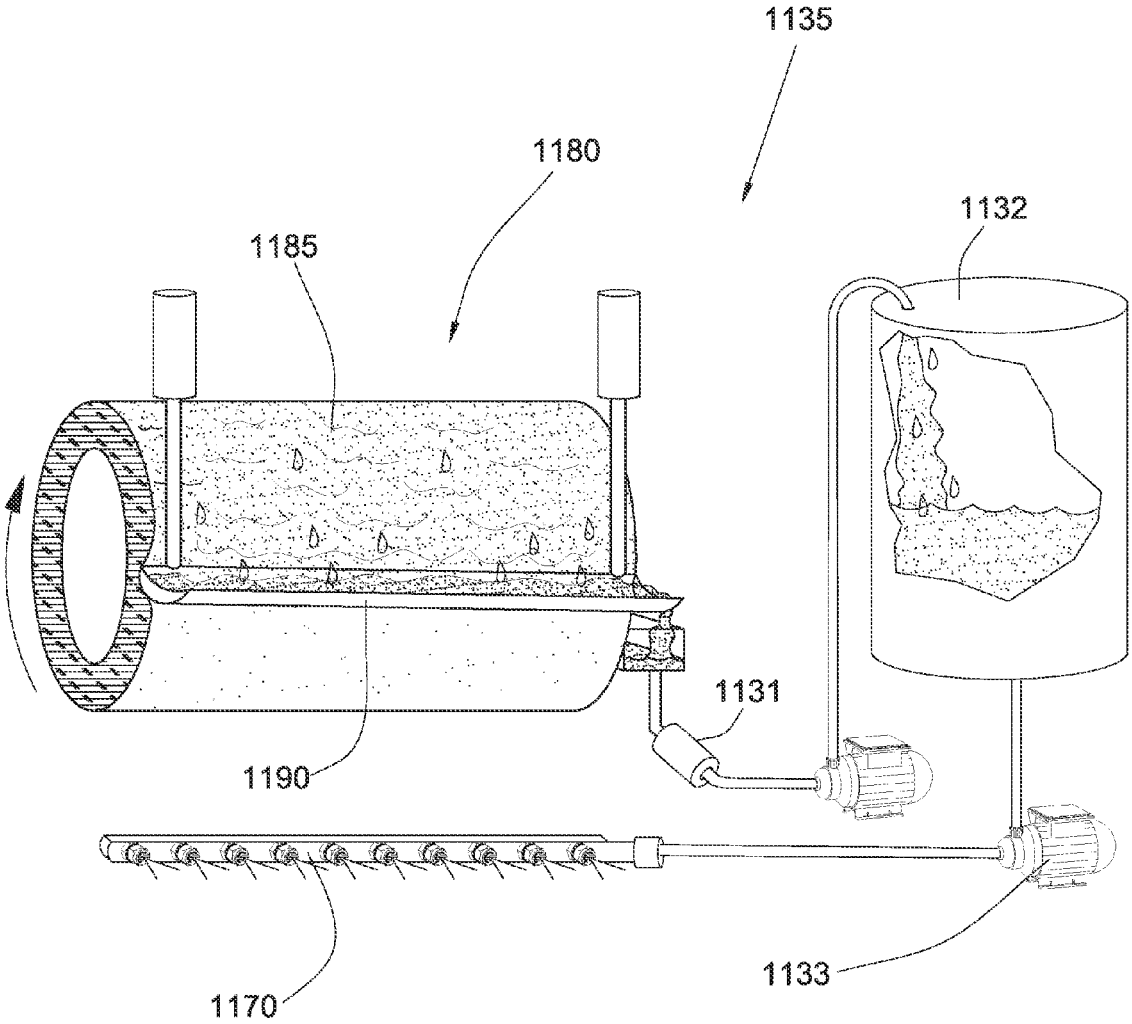
FIG. 11 shows a schematic view of an embodiment of a moisture collection system.

FIG. 11 discloses an embodiment of a moisture collection system 1135 to gather fluid removed from a roller 1180. In the embodiment shown, fluid is squeezed from an absorbent material 1185 by a wringer 1190 shaped like a channel. The channel shape of the wringer 1190 may capture fluid as it is wrung from the absorbent material and channel that fluid through a filter 1131 and towards a reservoir 1132 that may store the fluid. This reclaimed fluid may then be recycled to a jet system 1170 that may clean additional aggregate from a surface. Pumps 1133 may additionally be used to facilitate fluid travel through the moisture collection system 1135.

Figure 12:
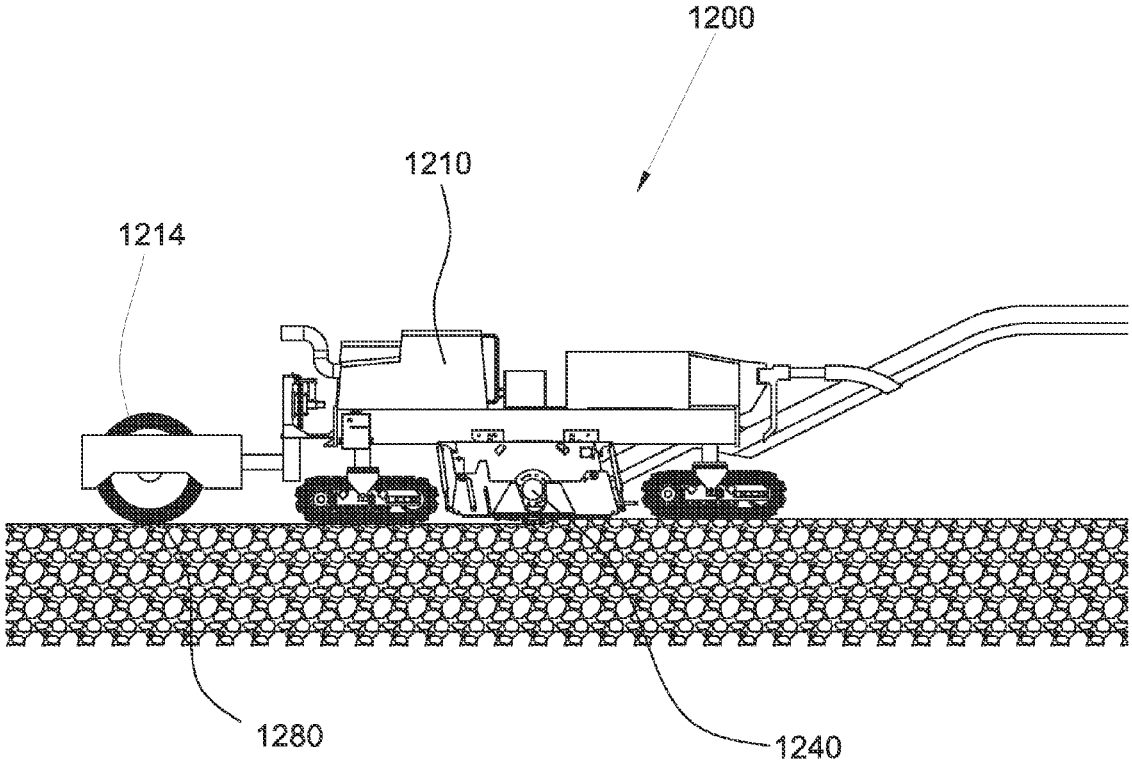
FIG. 12 shows a side view of an embodiment of a surface preparation system comprising a road milling machine with a degradation drum and a jet system pulling a separate vehicle comprising a roller disposed thereon.

FIG. 12 discloses an embodiment of a surface preparation system comprising a road milling machine 1200. The road milling machine 1200 may comprise a self-propelled vehicle 1210 comprising a degradation drum 1240 disposed on an underside of the vehicle 1210. A roller 1280 may be pulled by the road milling machine 1200 on a separate vehicle 1214.

Figure 13:
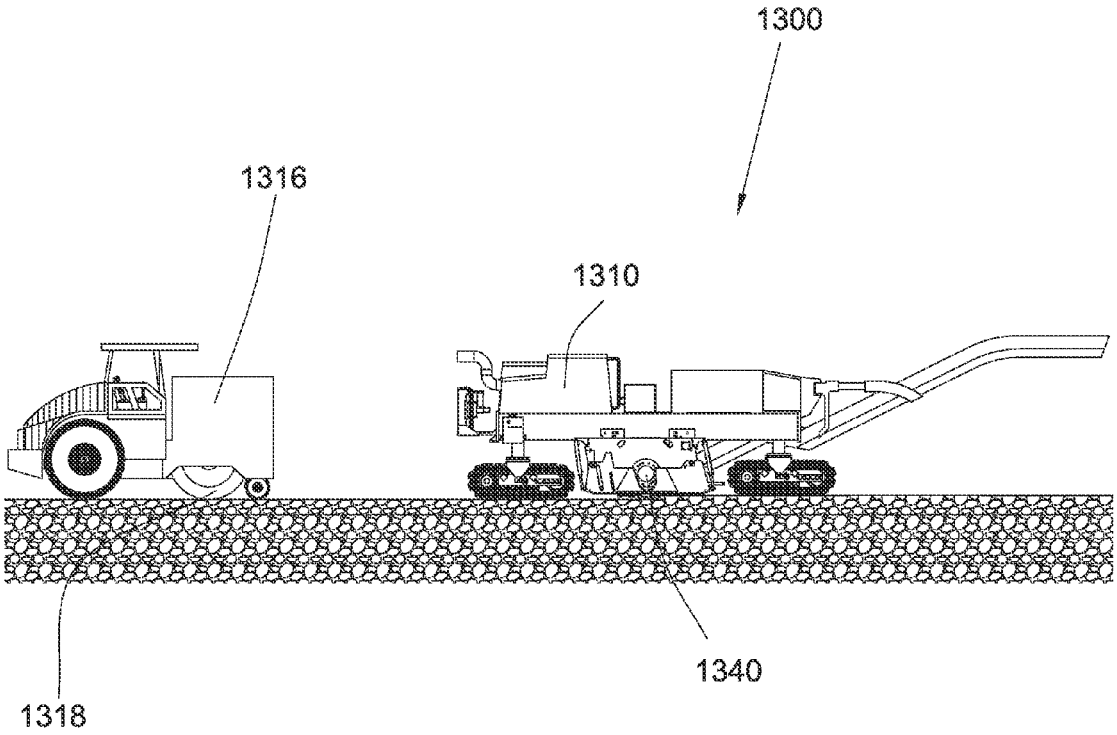
FIG. 13 shows a side view of an embodiment of a surface preparation system comprising a road milling machine with a degradation drum and a jet system followed by a separate self-propelled vehicle comprising a roller disposed thereon.

FIG. 13 discloses an embodiment of a surface preparation system comprising a road milling machine 1300 comprising a self-propelled vehicle 1310 with a degradation drum 1340 thereon. A roller 1318 may be disposed on a separate self-propelled vehicle 1316.

What is claimed is:

1. A surface preparation system, comprising:

a degradation drum comprising a plurality of picks disposed thereon to degrade a surface;

a jet system to clean the surface with fluid after degradation; and a roller comprising an absorbent material to absorb the fluid from the surface.

2. The system of claim 1, wherein the degradation drum and roller are disposed on a single vehicle.

3. The system of claim 1, wherein the degradation drum and roller are disposed on separate vehicles.

4. The system of claim 3, wherein a first vehicle comprising the roller is pulled behind a second vehicle comprising the degradation drum.

5. The system of claim 3, wherein a vehicle comprising the roller is self propelled.

6. The system of claim 1, wherein the absorbent material is disposed around an outer perimeter of the roller.

7. They system of claim 1, wherein the absorbent material is elastic.

8. The system of claim 7, wherein the absorbent material temporarily conforms to the surface.

9. The system of claim 1, further comprising a moisture extraction system to remove absorbed fluid from the roller.

10. The system of claim 9, wherein the moisture extraction system comprises a wringer to remove fluid by compressing at least a portion of the absorbent material.

11. The system of claim 10, wherein the wringer comprises a cylindrical rod.

12. The system of claim 11, wherein the cylindrical rod is rotatable around an axis.

13. The system of claim 10, wherein the wringer comprises a fluid channel.

14. The system of claim 9, wherein the moisture extraction system comprises a vacuum.

15. The system of claim 9, wherein the moisture extraction system comprises a heater.

16. The system of claim 9, further comprising a moisture collection system to gather removed fluid.

17. The system of claim 16, wherein the moisture collection system comprises a fluid reservoir.

18. The system of claim 16, wherein the moisture collection system comprises a pump and a filter.

19. The system of claim 16, wherein the moisture collection system recycles fluid to the jet system.

20. The system of claim 1, wherein the surface comprises pavement, concrete, cement, asphalt, macadam, tarmacadam or bitumen.

* * * * *